US008308284B2

(12) United States Patent
Kanada

(10) Patent No.: US 8,308,284 B2
(45) Date of Patent: Nov. 13, 2012

(54) RECORDING APPARATUS

(75) Inventor: Hidemasa Kanada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 374 days.

(21) Appl. No.: 12/637,204

(22) Filed: Dec. 14, 2009

(65) Prior Publication Data

US 2010/0149297 A1 Jun. 17, 2010

(30) Foreign Application Priority Data

Dec. 16, 2008 (JP) ..... 2008-319099

(51) Int. Cl.
*B41J 2/01* (2006.01)

(52) U.S. Cl. ..... 347/102; 219/216

(58) Field of Classification Search ..... 347/102; 219/216

See application file for complete search history.

(56) References Cited

U.S. PATENT DOCUMENTS

| | | | | |
|---|---|---|---|---|
| 4,142,301 | A * | 3/1979 | Goodall | 34/420 |
| 4,384,783 | A * | 5/1983 | Sakata et al. | 399/156 |
| 5,296,873 | A * | 3/1994 | Russell et al. | 346/25 |
| 6,390,618 | B1 * | 5/2002 | Wotton et al. | 347/102 |
| 6,439,712 | B1 * | 8/2002 | Mizutani et al. | 347/102 |
| 7,086,727 | B2 * | 8/2006 | Nishikawa et al. | 347/102 |
| 2010/0118096 | A1 * | 5/2010 | Mouri et al. | 347/102 |

FOREIGN PATENT DOCUMENTS

| | | | |
|---|---|---|---|
| EP | 1336503 | | 8/2003 |
| JP | 64-011841 | | 1/1989 |
| JP | 05042670 | A * | 2/1993 |

* cited by examiner

*Primary Examiner* — Daniel Petkovsek
(74) *Attorney, Agent, or Firm* — Workman Nydegger

(57) ABSTRACT

A recording apparatus which transports a recording material onto a recording support unit, ejects ink from a recording head to perform recording on the recording material, includes: a hot air generating unit which is provided at a holding member of the recording head on one side of the recording head; and an exhaust unit which is provided at the holding member on the other side of the recording head. Here, the recording apparatus is configured to form a first air stream in which hot air blown out from the hot air generating unit passes between the recording head and the recording support unit so as to reach the exhaust unit when the exhaust unit is in operation.

5 Claims, 14 Drawing Sheets

RECORDING APPARATUS

BACKGROUND

1. Technical Field

The present invention relates to a recording apparatus which is configured such that a recording material is transported to a recording material support unit, ink is ejected from a recording head in order to be recorded on the recording material, and the ink ejected onto a recording surface of the recording material is subjected to hot air in order to be heated and dried.

2. Related Art

Among the ink jet printers, there is an ink jet printer including a hot air generating unit which applies hot air to the ink ejected onto the recording surface of paper so as to heat and dry the ink, as shown in JP-A-64-11841. Further, in JP-A-64-11841, an ink jet recording apparatus is disclosed which includes the hot air generating units which are attached in an inclined posture in the vicinity of one side and both sides of a scanning direction of the recording heads.

However, in the case of the ink jet recording apparatus disclosed in JP-A-64-11841, there is no structure that can withdraw ink mist which is generated from ink droplets ejected in a recording operation and floating in a region facing the nozzle surface of the recording head. Therefore, even when the recording head does not eject the ink such that the apparatus is in a standby state, the ink mist is floating on the nozzle surface side.

For this reason, the ink mist slowly adheres to the nozzle surface of the recording head. The adhering ink mist easily solidifies under the influence of heat generated by the hot air generating unit which is disposed in the vicinity of the recording head. In a case where the ink mist adhering to the vicinity of the nozzle holes reaches a certain amount, when the recording head ejects ink to start the recording, the adhesion of the ink mist causes an ejecting error, so that an ejecting direction of the ink ejected from the nozzle hole is distorted. Therefore, deviation in landing positions on the recording surface is induced, so that the recording quality is reduced. In particular, the problem easily occurs in a line printer in which the recording heads normally do not move.

SUMMARY

An advantage of some aspects of the invention is to provide a recording apparatus including a recording head and a hot air generating unit, in which the recording apparatus withdraws floating ink mist in a region of a nozzle surface of the recording heads when ink is not ejected from the recording head.

According to a first aspect of the invention, there is provided a recording apparatus which transports a recording material onto a recording support unit, ejects ink from a recording head to perform recording on the recording material, including: a hot air generating unit which is provided at a holding member of the recording head on one side of the recording head; and an exhaust unit which is provided at the holding member on the other side of the recording head. Here, the recording apparatus is configured to form a first air stream in which hot air blown out from the hot air generating unit passes between the recording head and the recording support unit so as to reach the exhaust unit when the exhaust unit is in operation.

According to this aspect, since the recording apparatus is configured to form a first air stream in which hot air blown out from the hot air generating unit passes between the recording head and the recording support unit so as to reach the exhaust unit when the exhaust unit is in operation, ink mist floating in a region of the nozzle surface of the recording head can be withdrawn when ink is not ejected from the recording head. That is, the ink mist floating on a side of the nozzle surface of the recording head is absorbed together with the hot air, so that it is possible efficiently to withdraw the ink mist.

As a result, the ejection error caused by the attachment of the ink mist, by which the ejection direction of the ink ejected from the nozzle hole is distorted, can be prevented. In addition, it is possible to prevent the problem inducing the deviation in landing positions on the recording surface.

In addition, since the recording head, the hot air generating unit, and the exhaust unit are integrally supported by the holding member, a relative position among the recording head, the hot air generating unit, and the exhaust unit is normally constant, so that a heating and drying operation and an exhaust operation are constantly obtained.

According to a second aspect of the invention, in the recording apparatus of the first aspect, the hot air generating unit is configured to change a wind direction thereof. In addition, when the recording head stops the recording after the recording operation is started, the exhaust unit operates and the hot air generating unit changes the wind direction so as to form the first air stream. Here, the phrase "after the recording operation is started" means that ink begins to be ejected in order to carry out the recording corresponding to one recording job.

According to the aspect, since the hot air generating unit is configured to change the wind direction, the first air stream can be formed with safety.

According to a third aspect of the invention, in the recording apparatus of the second aspect, the hot air generating unit is configured to switch between at least a wind direction when the first air stream is formed and a wind direction when another air stream different from the first air stream is formed in a state where the exhaust unit is in a non-operating state.

According to the aspect, since the "first air stream" which is formed when the ink mist is withdrawn and the "another air stream" which is formed when the hot air generating unit performs preheating or main heating on the recording material are switched, the respective effect can be sufficiently manifested.

According to a fourth aspect of the invention, in the recording apparatus of the second or third aspect, the holding member is configured with a carriage which reciprocates the recording head in a direction perpendicular to the transport direction. In addition, the hot air generating unit is moved by the carriage, and comes into contact with a hitting member which is provided on one end side of the carriage in a reciprocal direction, so that a wind direction is automatically changed when the first air stream is formed.

According to the aspect, the wind direction of the hot air generating unit can be switched automatically by the hitting member.

According to a fifth aspect of the invention, in the recording apparatus of the fourth aspect, the hot air generating unit is configured to switch a wind direction via a wind direction switching mechanism. In addition, the wind direction switching mechanism includes a hot air box which is provided with a bearing unit which is pivotally rotated in a range of a predetermined angle around a pivotal shaft, the hitting member which comes into contact with a part of the hot air box so as to pivotally rotate the hot air box in a range of a predetermined angle around the pivotal shaft, an urging member which urges the hot air box to be rotated in a direction opposite to the pivotal direction, and a posture setting stopper which sets a normal posture in which the hot air box does not come into contact with the hitting member.

According to the aspect, with such a mechanism for switching the wind direction of the hot air generating unit, the configuration can be simplified and realized with a small number of components.

According to a sixth aspect of the invention, in the recording apparatus of the fourth aspect, a capping device for the recording head is provided on the other end side which is opposite to the hitting member in the reciprocal direction of the carriage. In addition, the hot air generating unit is provided on a side of the recording head facing the hitting member. The exhaust unit is provided on a side of the recording head facing the capping device.

According to the aspect, when the recording head moves to a home position or when the recording head performs a capping or a waste liquid treatment at the home position, the hot air blown out from the hot air generating unit is applied to the recording head.

BRIEF DESCRIPTION OF THE DRAWINGS

The invention will be described with reference to the accompanying drawings, wherein like numbers reference like elements.

DESCRIPTION OF EXEMPLARY EMBODIMENTS

In the following, a recording apparatus according to the invention will be described. In the first place, an ink jet printer 1 is employed as the best mode for carrying out the recording apparatus according to the invention, and a first embodiment shown in FIGS. 1 to 7 and a second embodiment shown in FIGS. 10 to 14 will be described.

First Embodiment

Figure 1:
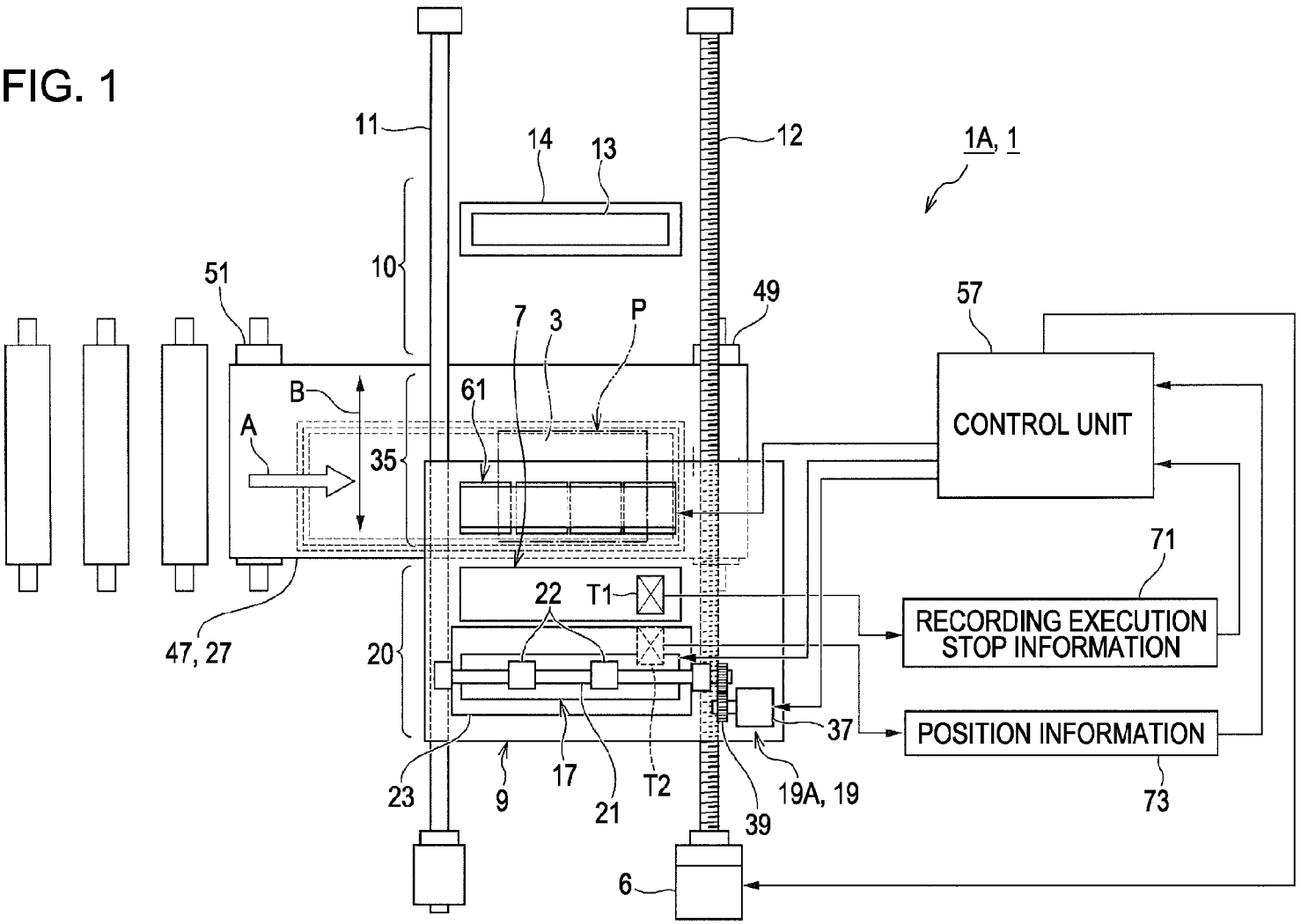
FIG. 1 is a plane view schematically illustrating an internal structure of an ink jet printer according to a first embodiment of the invention when a recording head is positioned on an exhaust position.
Figure 2:
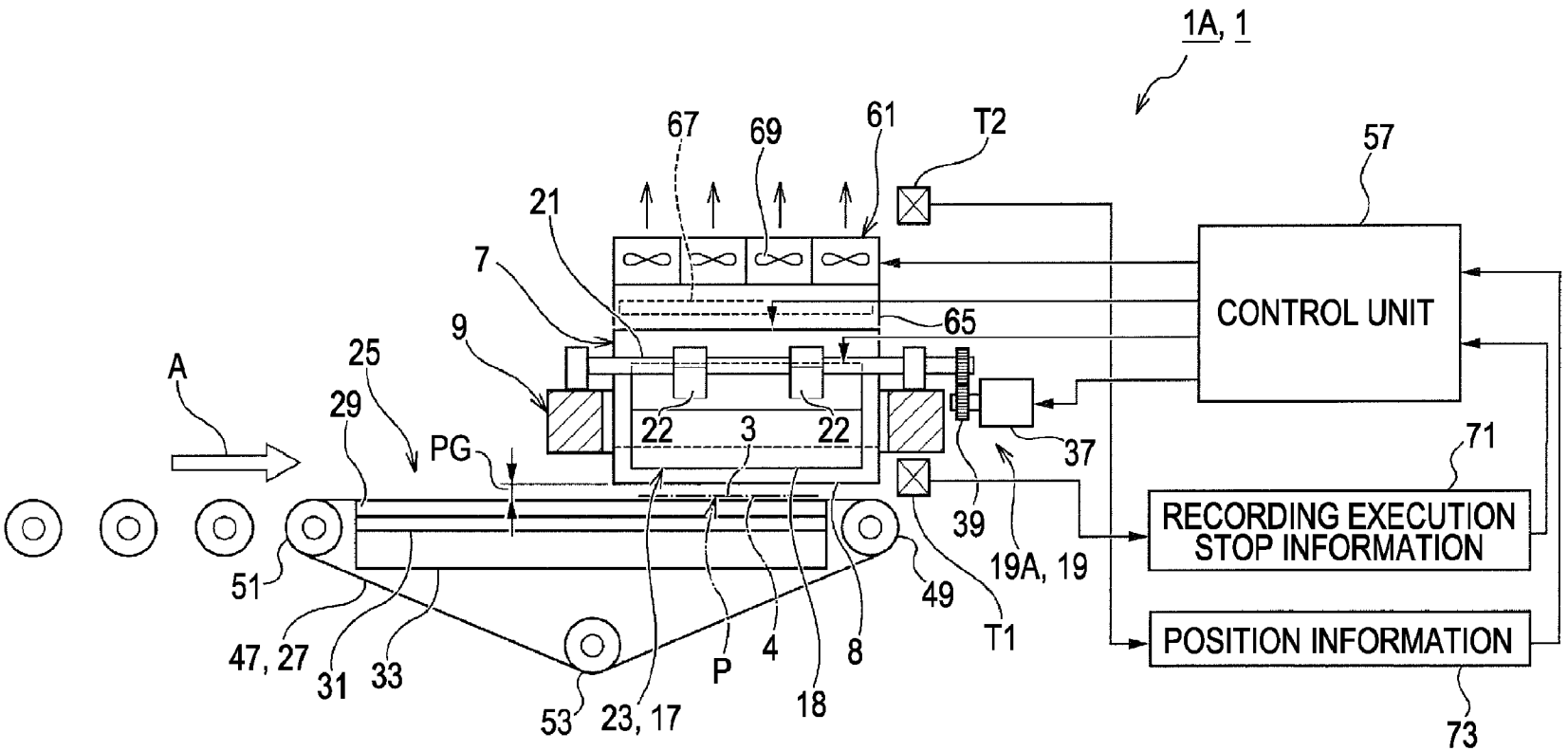
FIG. 2 is a sectional side view schematically illustrating the internal structure of the ink jet printer according to the first embodiment of the invention when the recording head is positioned on the exhaust position.
Figure 3:
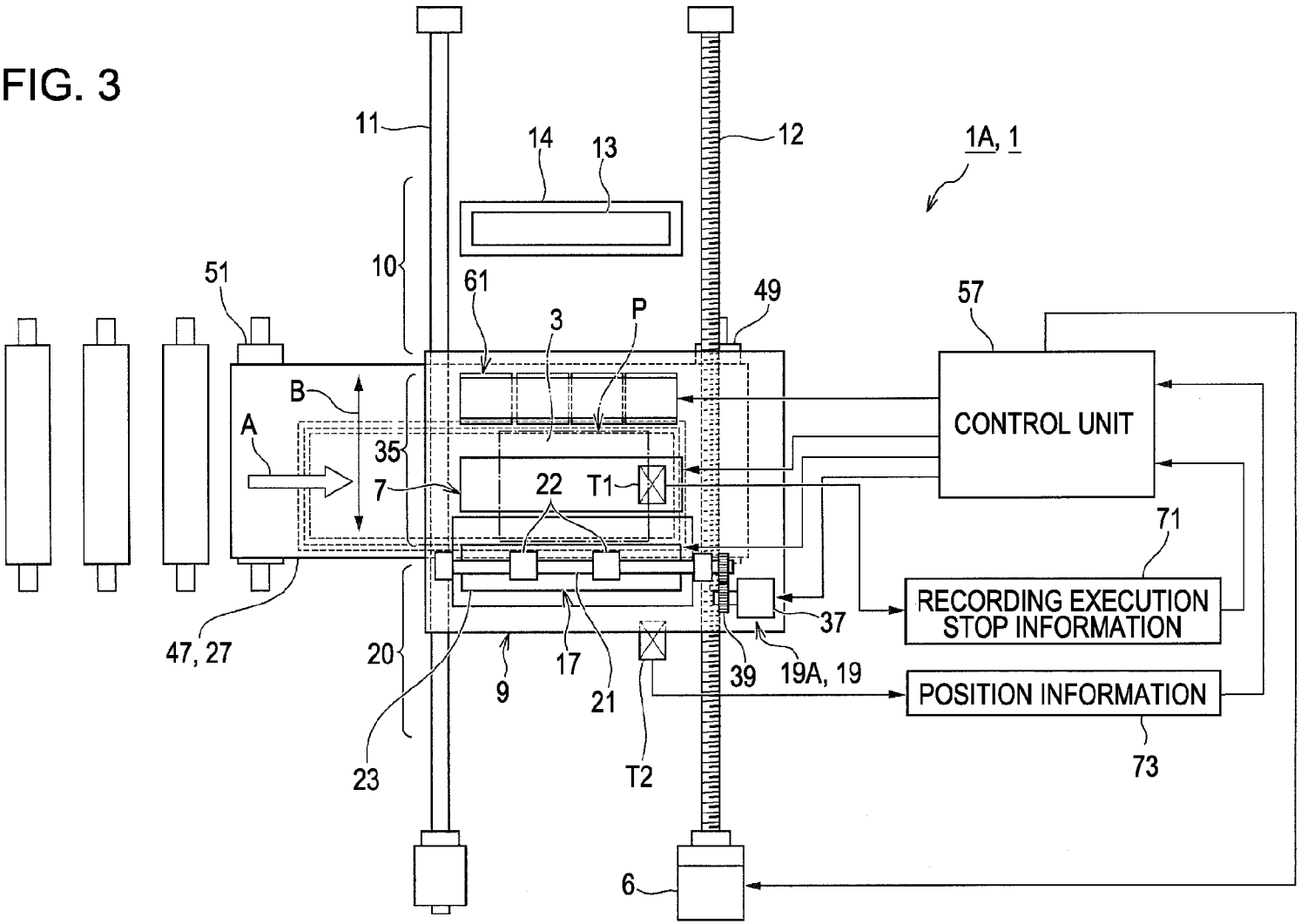
FIG. 3 is a plane view schematically illustrating the internal structure of the ink jet printer according to the first embodiment of the invention when the recording head is positioned in a recording execution region.
Figure 4:
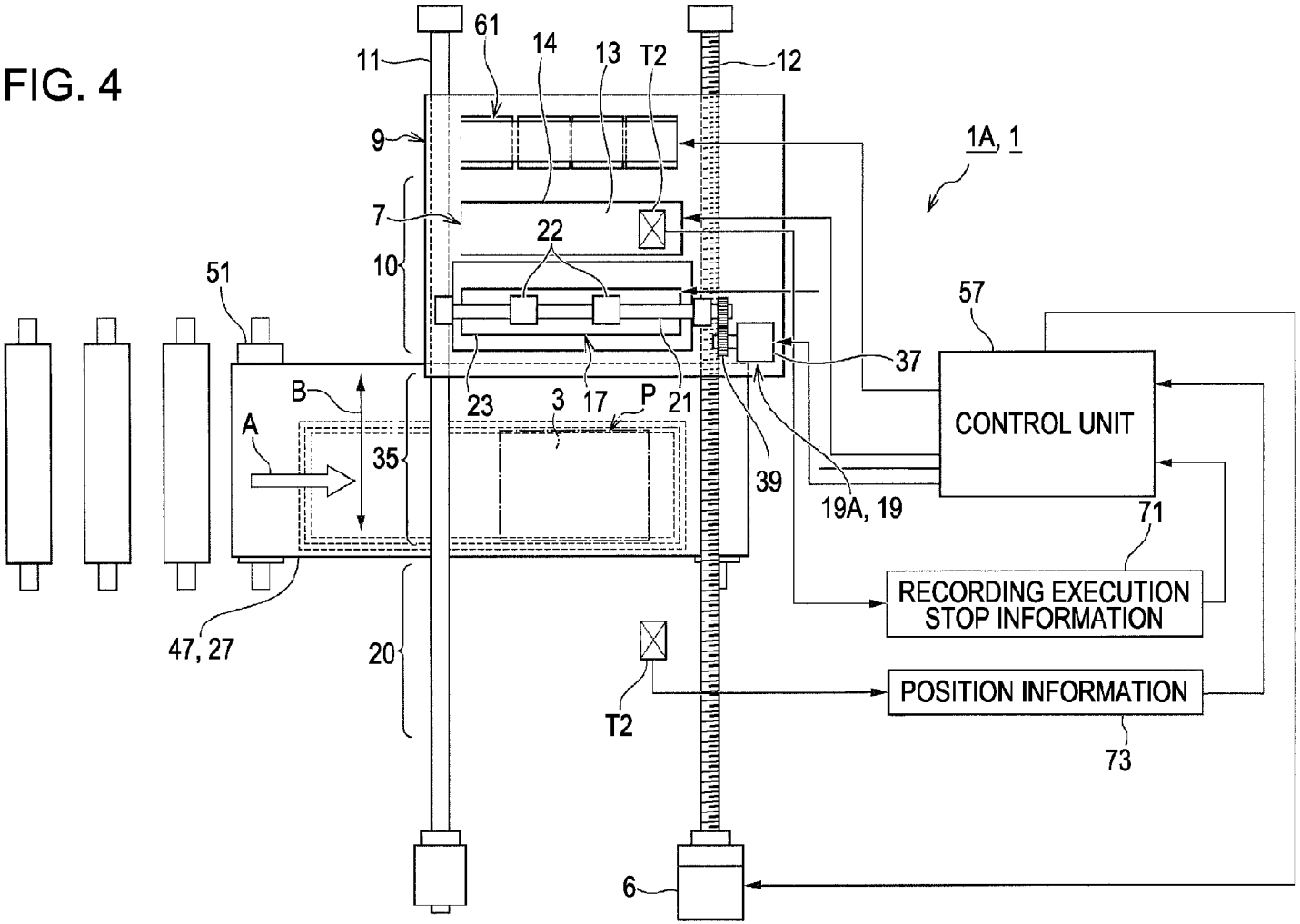
FIG. 4 is a plane view schematically illustrating the internal structure of the ink jet printer according to the first embodiment of the invention when the recording head is positioned on a home position.
Figure 5:
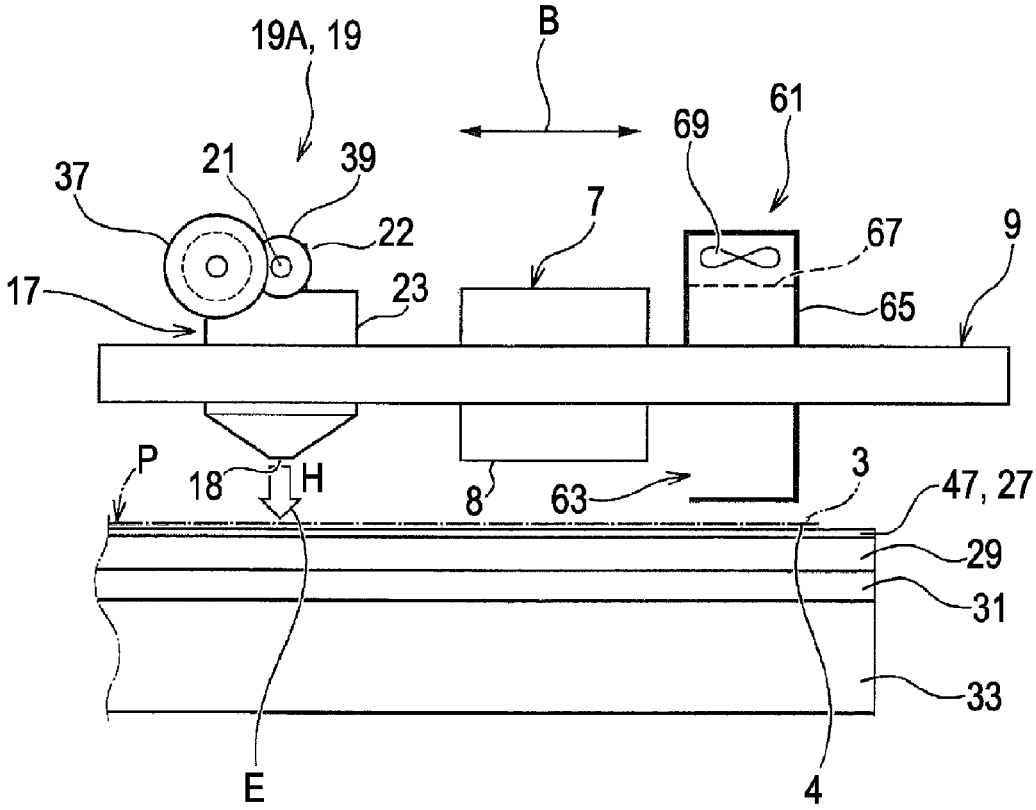
FIG. 5 is a rear view illustrating a recording head supported on a carriage, a hot air generating unit, and an exhaust unit in preliminary heating or main heating.
Figure 6:
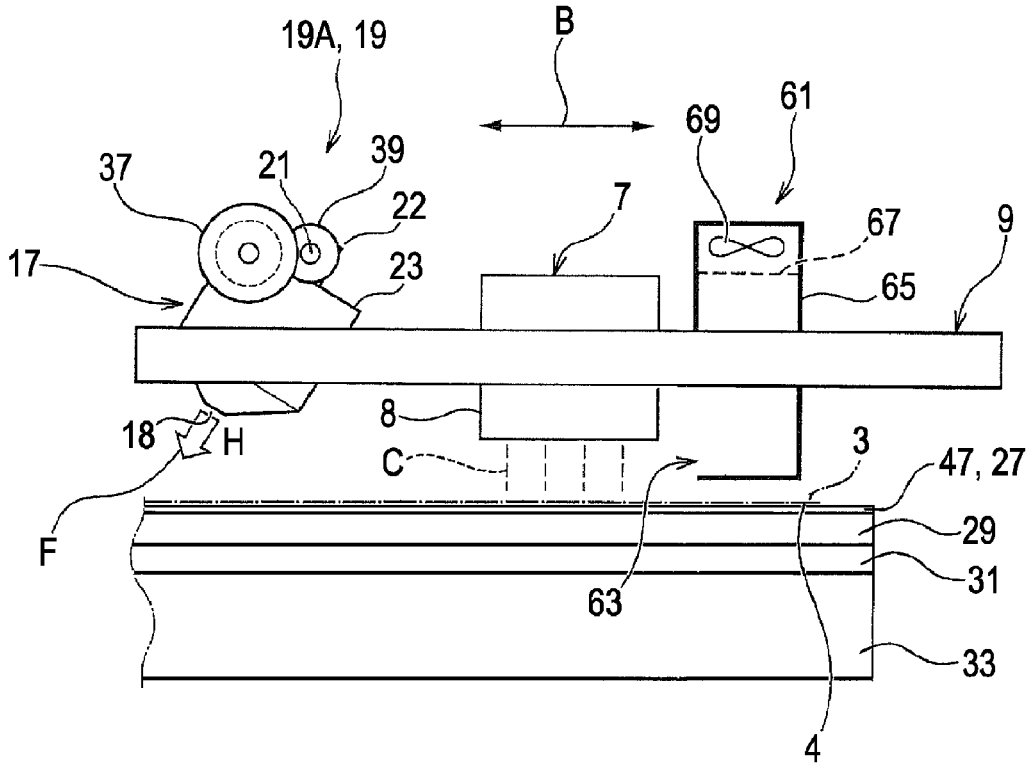
FIG. 6 is a rear view illustrating a recording head supported on a carriage, a hot air generating unit, and an exhaust unit in recording execution.
Figure 7:
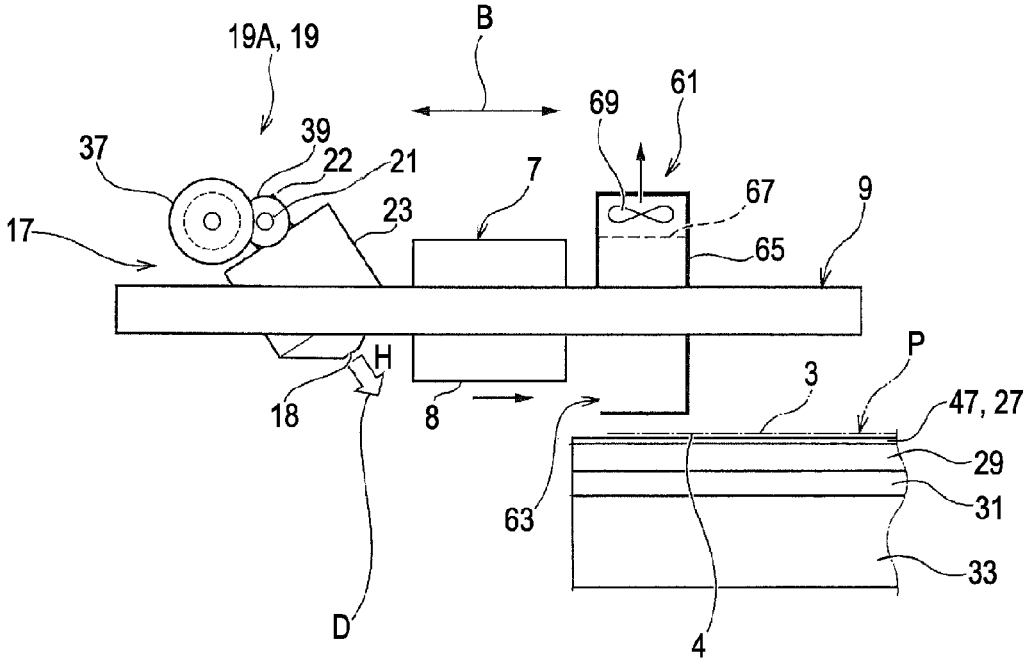
FIG. 7 is a rear view illustrating a recording head supported on a carriage, a hot air generating unit, and an exhaust unit in an exhaust process.

FIG. 1 is a plane view schematically illustrating an internal structure of an ink jet printer according to a first embodiment when a recording head is positioned on an exhaust position. FIG. 2 is a sectional side view schematically illustrating the same internal structure. In addition, FIG. 3 is a plane view illustrating the same internal structure when the recording head is positioned on a recording execution region. FIG. 4 is a plane view illustrating the same internal structure when the recording head is positioned on a home position. FIG. 5 is a rear view illustrating a state where the recording head, a hot air generating unit, and an exhaust unit are integrally supported by a carriage in preliminary heating or main heating. FIG. 6 is a rear view illustrating the same state in recording execution when ink is being ejected. FIG. 7 is a rear view illustrating the same state when the exhaust unit is operated.

An ink jet printer 1A according to the first embodiment includes: a recording head 7 which ejects the ink C onto the recording surface 3 of the recording material (hereinafter, referred to as paper) P so as to perform recording; a hot air generating unit 17 which applies the hot air H to the recording surface 3 of the paper P so as to heat and dry the ink C before the recording is performed, that is, before the ink C is ejected from the recording head 7, while the recording is being performed in which the ink C is ejected from the recording head 7, and a series of recording operations after the recording is performed in which the ink C is ejected from the recording head 7 and disappears; and an exhaust unit 61 which absorbs and captures the hot air H together with floating ink mist generated from the ink C which is ejected from a nozzle surface 8 of the recording head 7. Further, the ink jet printer 1A is configured to include: a carriage 9 in which the recording head 7 is disposed on the center portion thereof in a scanning direction B perpendicular to a transport direction A of the paper P, the hot air generating unit 17 is disposed on one side of the recording head 7, and the exhaust unit 61 is disposed on the other side of the recording head, and the carriage 9 being a holding member which reciprocates integrally the hot air generating unit 17, the recording head 7, and the exhaust unit 61 in the scanning direction B; and a transport support device 25 which supports the paper P from a lower side of the paper so as to be transported to a recording execution region 35.

The recording head 7 is disposed on the center portion of the carriage 9 in the scanning direction B as described above. The ink of each color is supplied from an ink cartridge (not shown) to the recording head 7, so that the ink is ejected from the nozzle surface 8, which is a lower surface of the recording head 7, to the paper P disposed on the lower side of the nozzle surface. In addition, with the carriage 9, the recording head 7 can move among a home position 10 at which a capping device 13 is provided, the recording execution region 35 on which the recording head 7 is positioned when the recording is performed, and an exhaust position 20 on which the recording head 7 is positioned at the time of exhausting to be described later. The capping device 13 is provided with a waste liquid unit 14.

The hot air generating unit 17 is a heating unit for generating the hot air H. The hot air generating unit 17 blows off the hot air H, which is supplied from a hot air generating device (not shown) and blown from a blow-out port 18, toward the recording surface 3 of the paper P which is absorbed and held by the transport support device 25 to be described later and transported in the transport direction A. Then, in this embodiment, the hot air generating unit 17 is provided at an end portion of the carriage 9 which is one side of the recording head 7 in a moving direction, that is, a side of the exhaust position 20 opposite the home position 10.

In addition, the hot air generating unit 17 is provided via a wind direction switching mechanism 19A which orients the blow-out port 18 of the hot air H toward an inner direction D (see FIG. 7) in which the recording head 7 exists, a lower direction E (see FIG. 5) in which the paper P exists, and an outer direction F (see FIG. 6) opposite to the recording head 7. In this embodiment, the wind direction switching mechanism 19A is provided with bearing units 22 and 22 which are configured to be pivotally rotated in a range of a predetermined angle around the pivotal shaft 21. In addition, the wind direction switching mechanism 19A is configured to include a hot air box 23 which is provided with the blow-out port 18 on the lower surface thereof, an angle adjustment motor 37 which generates torque required for pivotally rotating the hot air box 23, and a gear ring array 39 which transports the rotation of an output shaft of the angle adjustment motor 37 to the pivotal shaft 21.

The angle adjustment motor 37 rotates in a range of a predetermined angle, so that the hot air box 23 can be rotated around the pivotal shaft 21 and the blow-out port 18 is allowed to be switched to the inner direction D, the lower direction E, and the outer direction F. In addition, as shown in FIG. 5, the blow-out port 18 of the hot air generating unit 17 is faced to the lower direction E in order to increase drying efficiency of the paper P in preliminary heating or in main drying. As shown in FIG. 6, the blow-out port 18 is faced to the outer direction F in order to reduce the adverse effect on the recording head 7 when the recording is performed. As shown in FIG. 7, the blow-out port 18 is faced to the inner direction D in order to form a first air stream in which the hot air H blew out from the hot air generating unit 17 passes under the recording head 7 so as to reach the exhaust unit 61 to be described later.

The exhaust unit 61 is a unit for forming suction air which is used to withdraw the ink mist. In this embodiment, the exhaust unit 61 is provided at the other end of the recording head 7 in a moving direction, that is, an end portion of the carriage 9 which is a side of the home position 10 at which the capping device 13 and the waste liquid unit 14 are provided. The exhaust unit 61 is configured to include an exhaust duct 65 of which a suction inlet 63 is provided on a lower surface thereof facing the recording head 7 and has a box shape for example, a filter 67 which is used to capture the ink mist and provided on an exhaust path above the exhaust duct 65, and four exhaust fans 69, 69, 69, and 69 which are provided on the exhaust path above the filter 67 for example.

The carriage 9 accommodates the recording head 7, the hot air generating unit 17, and the exhaust unit 61, and serves as a moving device for reciprocating these units in the scanning direction B. The carriage 9 is guided by a guide shaft 11 which is suspended in the scanning direction B so as to go across the transport support device 25 to be described later. The carriage 9 is supported by a screw shaft 12 through which driving force of a carriage scanning motor 6 is transferred so as to be reciprocated in the scanning direction B. The carriage scanning motor 6 is connected to the screw shaft 12 and can be forward or reverse rotated.

The transport support device 25 is basically configured to include a transport guide member 27 which guides the paper P to the recording execution region 35, a platen 29 which is a recording material support unit for supporting the lower surface 4 of the paper P transported to the recording execution region 35 and defining a gap PG between the recording head 7 and the paper P, and a platen heater 31 which heats the platen 29 and preheats the paper P, which is disposed on the platen 29, via the platen 29.

In this embodiment, a belt type transport guide member is employed, which is provided with an endless suction belt 47 as the transport guide member 27 in which a large number of small holes (not shown) are formed, a driving roller 49 which applies transport driving force on the suction belt 47, a driven roller 51, and a tension roller 53. Further, a large number of holes are also formed in the platen 29 and the platen heater 31, which are omitted in the drawing, and the suction air generated by suction fans 33 which are disposed under the platen heater 31 flows into the holes, so that the paper P placed on the suction belt 47 can be adsorbed and held.

Additionally, in this embodiment, an ink ejection sensor T1 which is used to detect whether or not the ink C is ejected from the recording head 7, and a position sensor T2 which is used to detect a position of the carriage 9 are provided. Further, a control device 57 is provided to control each operation of the recording head 7, the hot air generating unit 17, the exhaust unit 61, and the transport support device 25 before and after the recording is performed and while the recording is being performed, on the basis of recording execution stop information 71 obtained by the ink ejection sensor T1 and position information 73 of the carriage 9 obtained by the position sensor T2.

Further, the recording execution stop information and the position information can be obtained on the basis of the basic operation determined as the original recording apparatus and recording operations determined according to recording data, so that the control of each operation of the recording head 7, the hot air generating unit 17, the exhaust unit 61, and the transport support device 25 can also be performed without providing the ink ejection sensor T1 and the position sensor T2.

As the position information 73 obtained by the position sensor T2, position information on whether or not the carriage 9 is positioned on the home position 10, or on the recording execution region 35, or on the exhaust position 20 is exemplified. In addition, the recording operations of the recording head 7, the hot air generating unit 17, and the exhaust unit 61 which are performed by the control device 57 are illustrated in FIGS. 5 to 7.

That is, as shown in FIG. 5, in the preliminary heating in which the recording material is heated in advance before the recording is started, or in the main drying which is performed after the recording head ends the recording, the recording head 7 and the exhaust unit 61 come to be in the OFF state and the hot air generating unit 17 comes to be in the ON state, and the wind direction becomes the lower direction E. As shown in FIG. 6, when the recording is performed, the exhaust unit 61 comes to be in the OFF state, and the recording head 7 and the hot air generating unit 17 come to be in the ON state, and the wind direction of the hot air generating unit 17 becomes the outer direction F. When the recording is stopped after it is started, that is, at the time of exhausting, the recording head 7 comes to be in the OFF state, and the hot air generating unit 17 and the exhaust unit 61 come to be in the ON state, and the wind direction of the hot air generating unit 17 becomes the inner direction D, which will be described later.

Operation

Next, while explaining a series of operation flows from the recording execution start to the recording execution end in a case where the recording is performed by the recording apparatus according to the embodiment with reference to FIGS. 8 and 9, the operations of the invention will be described.

Figure 8:
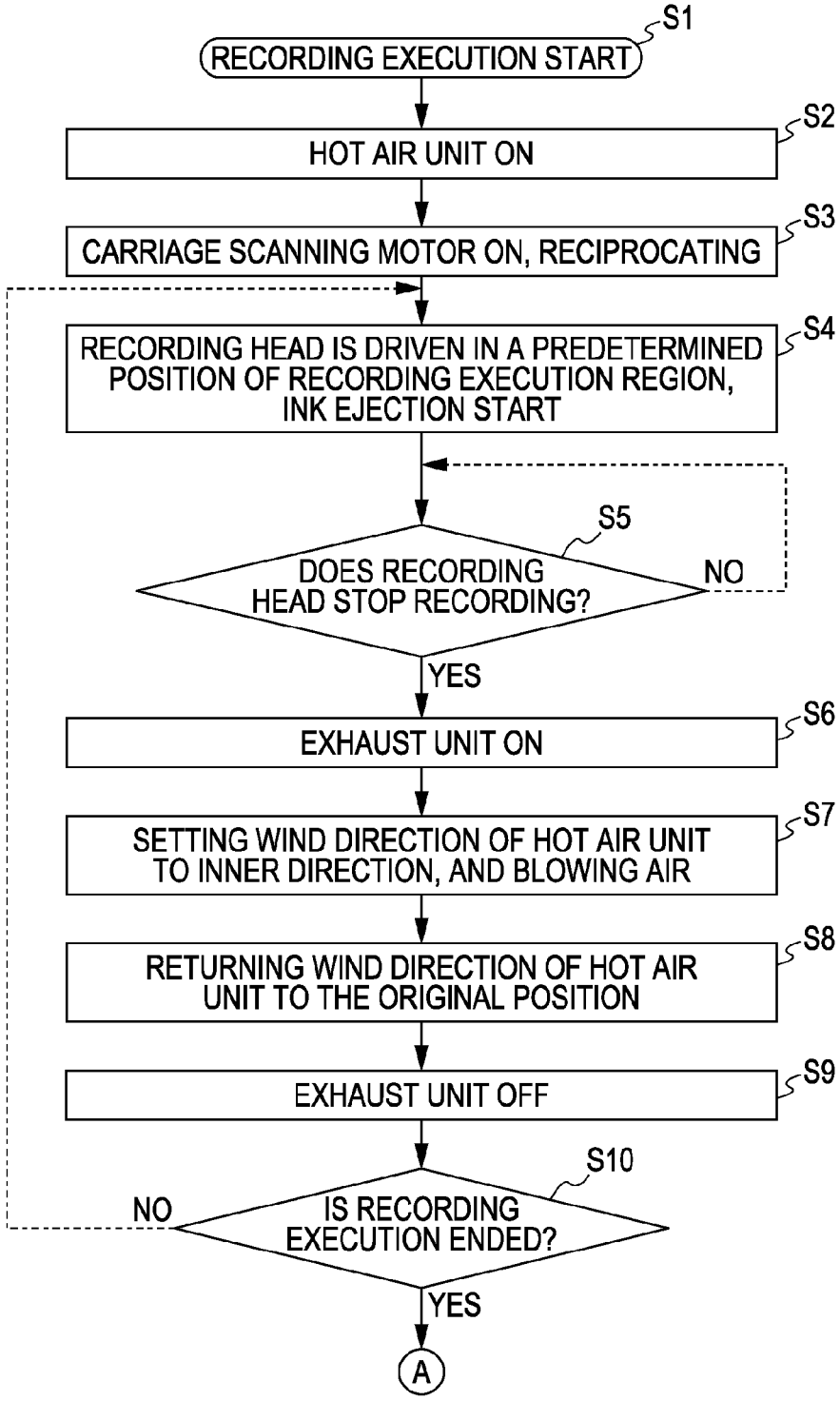
FIG. 8 is a first half flowchart illustrating an operation of the recording apparatus according to the first embodiment.
Figure 9:
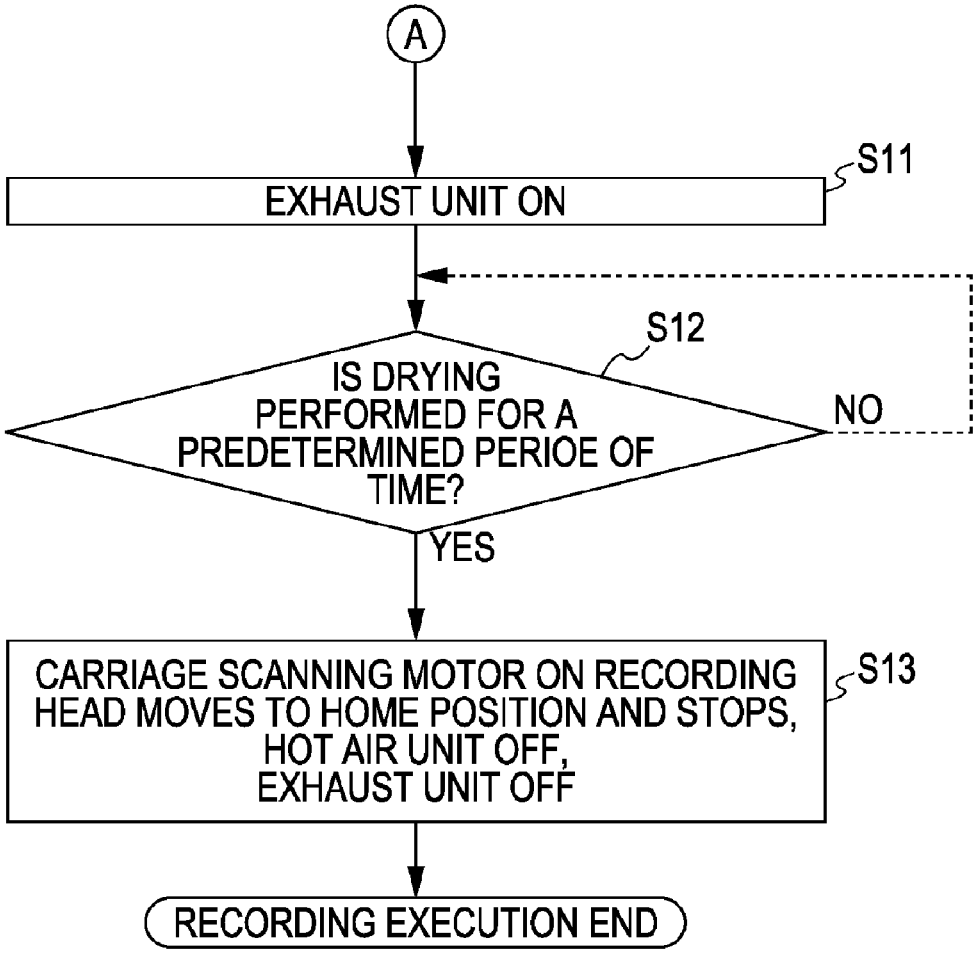
FIG. 9 is a second half flowchart illustrating an operation of the recording apparatus according to the first embodiment.

FIG. 8 is a first half flowchart illustrating the operation flow from the recording execution start to the recording execution end performed by the recording apparatus. FIG. 9 is a second half flowchart illustrating the same operation flow shown in FIG. 8.

First, a user sets the recording material P on the recording apparatus 1, and in step S1, sets the kind of the recording material P or a recording mode such as a recording speed and pushes a recording execution start button, so that the execution is started. Then, the transport support device 25 receives the recording execution command generated in step S1 and begins to operate, absorbs and holds the recording material P on the suction belt 47, and then transports the recording material P toward the recording execution region 35.

Next, the procedure proceeds to step S2, and the hot air generating unit 17 comes to be in the ON state. Further, the wind direction at this time is set such that the blow-out port 18 is faced to the lower direction for example, as shown in FIG. 5. Then, the procedure proceeds to step S3, and the carriage scanning motor 6 comes to be in the ON state. Through this, the carriage 9 moves from the home position 10 to the recording execution region 35, and reciprocates the recording execution region 35 in the scanning direction B so as to preheat the recording material P, so that the ejected ink is easily dried in this state.

After the preheating of the recording material P is ended, the procedure proceeds to step S4, and the recording is performed by ejecting the ink C from the nozzle surface 8 of the recording head 7. In this state, as shown in FIG. 6, the hot air generating unit 17 comes to be in the ON state with the blow-out port 18 faced to the outer direction F, and the exhaust unit 61 comes to be in the OFF state with the recording head 7 in the ON state. Next, the procedure proceeds to step S5, and it is determined whether or not the recording head 7 stops performing the recording.

Then, when it is determined that the recording is stopped that is, the recording head 7 is positioned on the exhaust position, and the ink C is not ejected from the recording head 7, the recording execution stop information 71 is sent to the control device 57, and the procedure proceeds to step S6, and then the exhaust unit 61 comes to be in the ON state. On the other hand, when it is determined that the recording is being performed, the recording in step S4 continues to be performed, and the determination in step S5 is repeatedly performed. When the exhaust unit 61 comes to be in the ON state in step S6, the procedure proceeds to step S7. The wind direction of the hot air generating unit 17 is faced to the inner direction D and the hot air H blows toward the recording head 7 for a predetermined period of time so as to form the first air stream. The ink mist floating under the nozzle surface 8 of the recording head 7 begins to be withdrawn (see FIG. 7).

Next, the procedure proceeds to step S8, and the wind direction of the hot air generating unit 17 is returned to the original position. The procedure proceeds to step S9, and the exhaust unit 61 comes to be in the OFF state. Then, in step S10, it is determined whether or not the recording is completed. When it is determined that the recording is not completed, the procedure is returned to step S4, and the recording continues and the ink mist under the recording head 7 continues to be withdrawn.

On the other hand, in step S10, when it is determined that the recording is completed, the procedure proceeds to step S11, and the exhaust unit 61 comes to be in the ON state. The hot air H blows from the hot air generating unit 17 to the lower side, and the main drying of the recording surface 3 is performed by the hot air H and the floating ink mist above the recording surface 3 is withdrawn.

In addition, the procedure proceeds to step S12, and it is determined whether or not the main drying is performed for a predetermined period of time. When the main drying is not performed for a predetermined period of time, the main drying continues. On the other hand, in step S12, when it is determined that the main drying is performed for a predetermined period of time, the procedure proceeds to step S13, and the carriage scanning motor 6 comes to be in the ON state when it is in the OFF state, and then the recording head 7 is caused to move to the home position 10 and stopped thereat. Then, the hot air generating unit 17 and the exhaust unit 61 come to be in the OFF state, and the series of the recording operations is completed.

Second Embodiment

Figure 10:
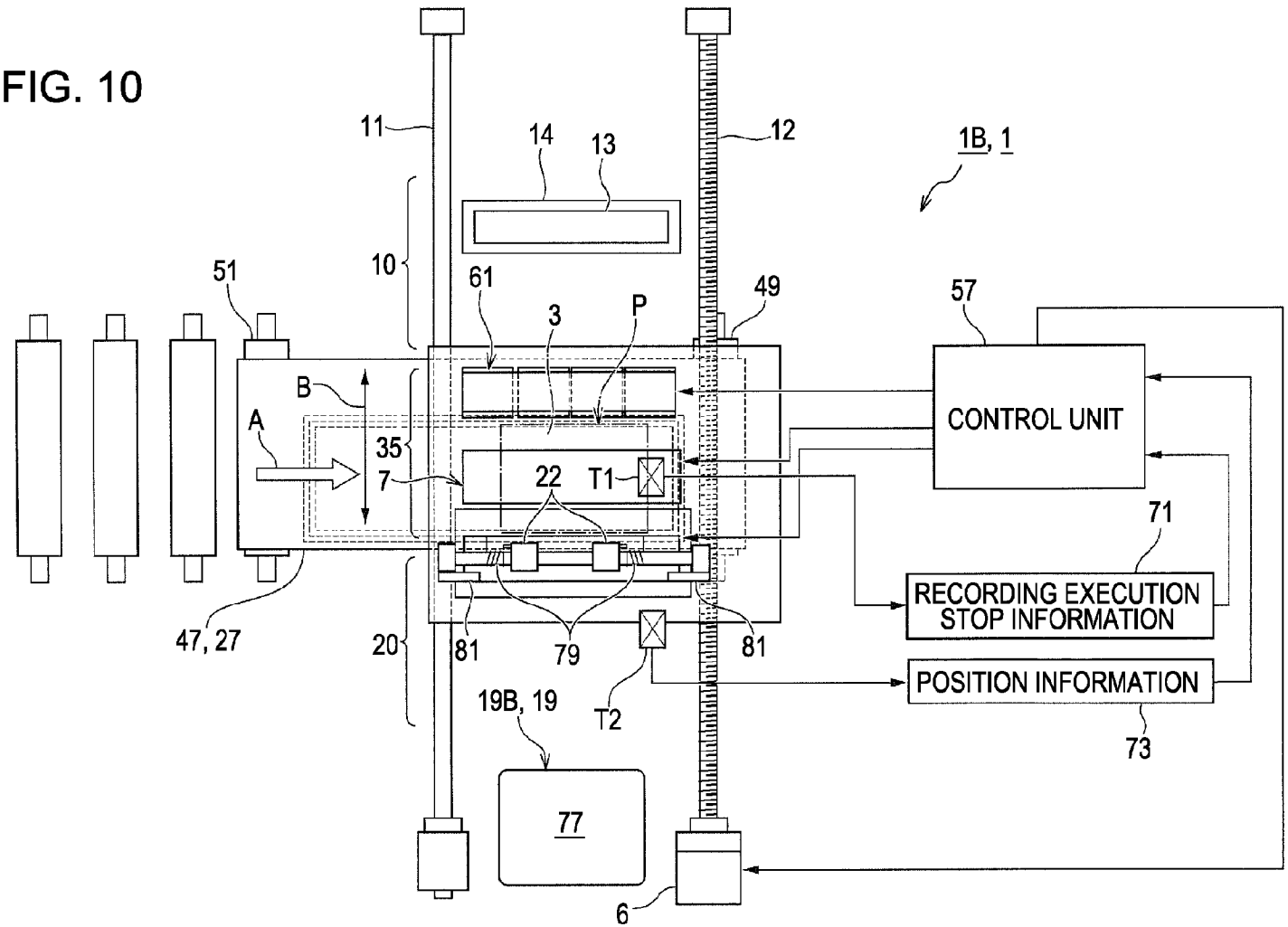
FIG. 10 is a plane view schematically illustrating an internal structure of an ink jet printer according to a second embodiment of the invention when a recording head is positioned on a recording execution position.
Figure 11:
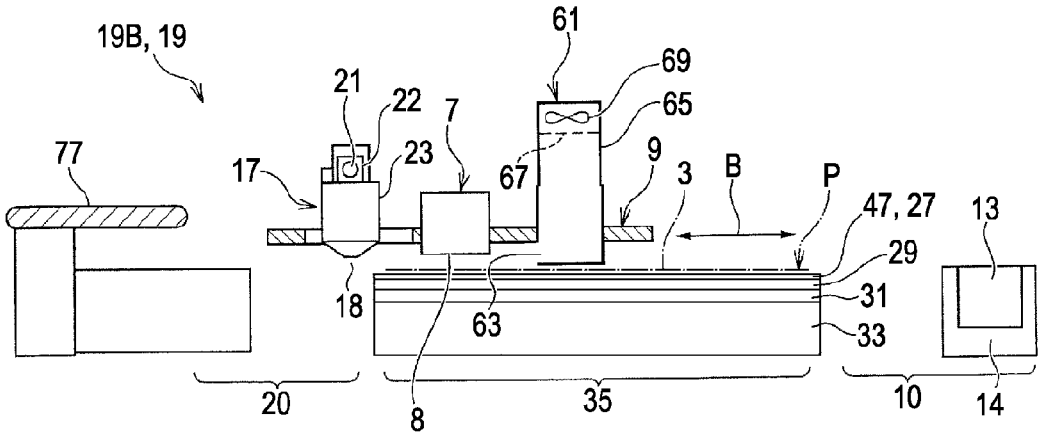
FIG. 11 is a rear view illustrating a wind direction switching mechanism and peripheral members when a carriage is positioned on a recording execution region.
Figure 12:
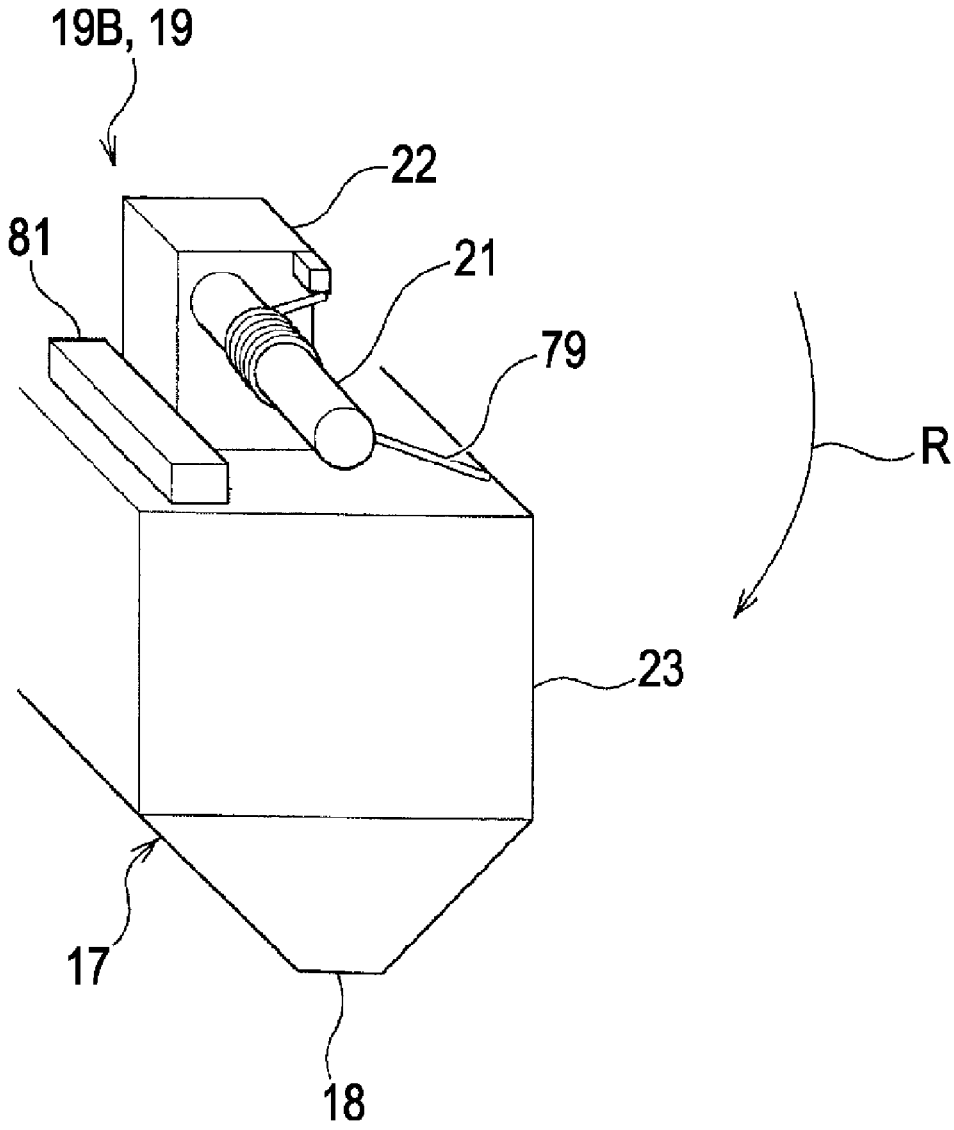
FIG. 12 is a perspective view illustrating a wind direction switching mechanism and peripheral members when a carriage is positioned on a recording execution region.
Figure 13:
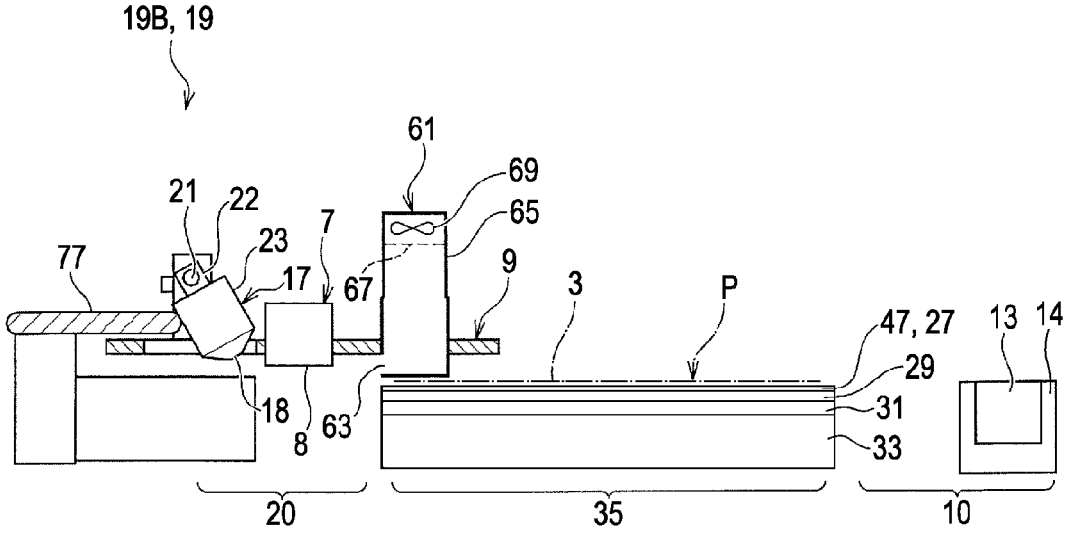
FIG. 13 is a rear view illustrating a wind direction switching mechanism and peripheral members when a carriage reaches an exhaust position.
Figure 14:
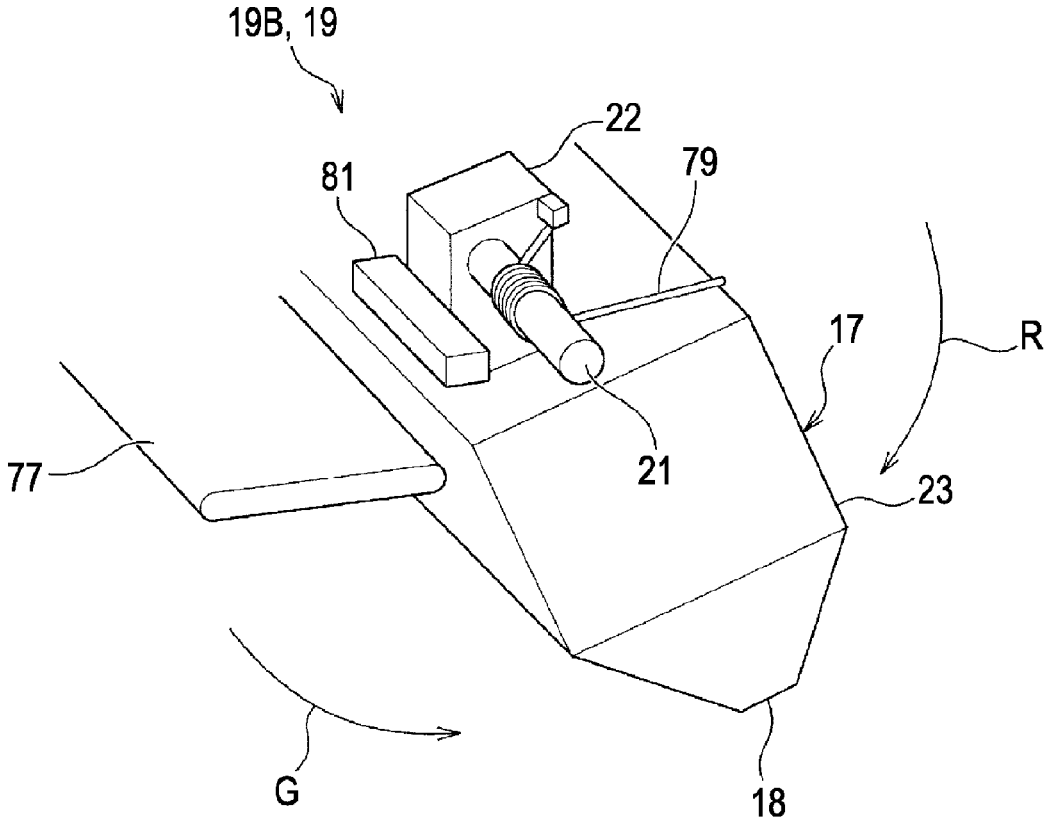
FIG. 14 is a perspective view illustrating a wind direction switching mechanism and peripheral members when a carriage reaches an exhaust position.

FIG. 10 is a plane view schematically illustrating an internal structure of an ink jet printer according to a second embodiment when the recording head is positioned on the recording execution region. FIG. 11 is a rear view illustrating a state where the carriage is positioned on the recording execution region, in which peripheral portions of the recording head, the hot air generating unit, and the exhaust unit according to the second embodiment are illustrated in an enlarged manner. FIG. 12 is a perspective view illustrating an operation state of the wind direction switching mechanism when the carriage is positioned on the recording execution region, in which peripheral portions of the recording head, the hot air generating unit, and the exhaust unit according to the second embodiment are illustrated in an enlarged manner. In addition, FIG. 13 is a rear view similarly illustrating a state where the carriage reaches the exhaust position. FIG. 14 is a perspective view similarly illustrating an operation state of the wind direction switching mechanism when the carriage reaches the exhaust position.

Similar to the ink jet printer 1A according to the first embodiment, the ink jet printer 1B according to the second embodiment includes the recording head 7, the hot air generating unit 17, the exhaust unit 61, the carriage 9, and the transport support device 25. Among these components, only the configuration of the wind direction switching mechanism 19 which is a part of the hot air generating unit 17 is different from that of the ink jet printer 1A according to the first embodiment. Therefore, in the following, the same configurations as those of the ink jet printer 1A according to the first embodiment will be omitted, and the description will be made focusing on the configuration of the wind direction switching mechanism 19B, which is different in configuration.

That is, in the second embodiment, the hot air generating unit 17 is moved by the carriage 9 so as to come into contact with the hitting member 77 which is provided on one end side of the carriage 9 in the reciprocal direction. Therefore, the hot air generating unit 17 is configured to be automatically changed according to the wind direction when the first air stream is formed. The wind direction switching mechanism 19B is provided with bearing units 22 and 22 which are configured to be pivotally rotated in a range of a predetermined angle around the pivotal shaft 21. In addition, the wind direction switching mechanism 19B is configured to include the hot air box 23 which is provided with the blow-out port 18 on the lower surface thereof, the rectangular flat plate-like hitting member 77 which comes into contact with a part of the hot air box 23 to be pivotally rotated in a range of a predetermined angle around the pivotal shaft 21 and has a rectangular flat plate-like shape for example, a torsion coil spring 79 which serves as an urging member for urging the hot air box 23 to rotate in a direction R opposite to the pivotal direction G, and a posture setting stopper 81 which sets a normal posture in which the hot air box 23 does not come into contact with the hitting member 77.

That is, as shown in FIGS. 11 and 12, the hot air box 23 and the hitting member 77 are separated from each other at a distance therebetween in a state where the carriage 9 is positioned in the recording execution region 35, and neither of them comes into contact with each other. Then, the hot air box 23 is rotated in the clockwise direction in the drawing by the urging force of the torsion coil spring 79 so as to be in a state where the upper surface of the hot air box 23 comes into contact with the posture setting stopper 81. In this state, the blow-out port 18 is faced to the lower direction E as shown in the drawing, and the posture becomes the normal posture of the hot air box 23.

On the other hand, as shown in FIGS. 13 and 14, the hot air box 23 comes into contact with the hitting member 77 in a state where the carriage 9 moves from the recording execution region 35 so as to reach the exhaust position 20. Therefore, the hot air box 23 rotates in the counterclockwise direction against the urging force of the torsion coil spring, and as shown in the drawing the blow-out port 18 is automatically held in the posture at the time of exhausting so as to be faced to the inner direction D. According to this embodiment as described above, the hot air box 23 cannot be pivotally rotated to be faced to the outer direction F. However, it is possible to rotate pivotally the hot air box 23 to be automatically faced to the inner direction D and the lower direction E without using a separate driving means such as the angle adjustment motor 37 which is provided in the first embodiment.

As described above, according to the recording apparatus of this embodiment, the recording apparatus includes the recording head 7 and the hot air generating unit 17. In the recording apparatus, it is possible to heat and dry the recording material P by the hot air H before and after the recording is performed and while the recording is being performed, and efficiently withdraw the ink mist under the recording head 7 using the hot air H without adversely affecting a travel locus of the ink C ejected from the recording head 7.

In addition, when the wind direction switching mechanism 19A according to the first embodiment is employed, the hot air box 23 can be freely adjusted in angle, so that the blow-out port 18 can be oriented toward the inner direction D, the lower direction E, and the outer direction F. In addition, when the wind direction switching mechanism 19B according to the second embodiment is employed, the blow-out port 18 of the hot air box 23 can be switched to the inner direction D and the lower direction E even though a separate driving mechanism is not provided.

Additionally, by using the platen heater 31 together with the hot air generating unit 17, the drying efficiency of the ink C ejected onto the recording material P or the recording surface 3 is improved, and polka dot patterned color unevenness, which occurs in a case where only the platen heater 31 is heated, is not generated. In addition, by employing the suction belt 47, it is possible to prevent a jam of the recording material P caused by curling of the recording material P on the platen 29, or uneven heating caused by floating of the recording material P. Furthermore, by employing the suction belt 47, even though the hot air is applied from the hot air generating unit 17 in a direction to float the recording material P, the recording material P is not turned over.

Another Embodiment

The recording apparatus according to the invention is basically configured as described above, but it is a matter of course that the configuration can be partially changed or omitted without departing from the main points of the invention.

For example, the above-mentioned recording apparatus is described as an example of the invention being applied to the ink jet printer in which the recording head 7 is mounted on the carriage 9 so as to be reciprocated. However, the invention may be applied to a line printer in which the recording head is fixed in a line shape. In this case, the hot air generating unit 17 and the exhaust unit 61 are disposed on an upstream side and a downstream side in the transport direction of the recording material P with the recording head 7 interposed therebetween. The wind direction switching mechanism of the hot air generating unit 17 is so realized as to be the structure in which the same angle adjustment motor 37 as that of the first embodiment is used.

In addition, when the execution of the recording by one period of scanning in the scanning direction B of the carriage 9, the drying of the recording material P by the hot air H, and the withdrawal of the ink mist using the hot air H can be performed, the transport support device 25 may be omitted. In addition, the structure of the wind direction switching mechanism 19 is not limited to the structures as described in the first and second embodiments, but various structures can be employed. For example, a structure in which cams or cranks are used or a structure in which plural blow-out ports 18 are provided in advance and selected to be used, or the like may be employed.

What is claimed is:

1. A recording apparatus which transports a recording material onto a recording support unit, ejects ink from a recording head to perform recording on the recording material, comprising:

a hot air generating unit which is provided at a holding member of the recording head on one side of the recording head; and an exhaust unit which is provided at the holding member on the other side of the recording head, wherein the recording apparatus is configured to form a first air stream in which hot air blown out from the hot air generating unit passes between the recording head and the recording support unit so as to reach the exhaust unit in a state where the exhaust unit is in operation, the hot air generating unit being at least partially pointed away from the recording material while generating the first air stream, wherein the recording apparatus is configured to form a second air stream in which hot air blown from the hot air generating unit is passed to the recording medium in a state where the exhaust unit is not in operation, the hot air generating unit being pointed at the recording material while generating the second air stream.

2. The recording apparatus according to claim 1, wherein the hot air generating unit is configured to change a wind direction thereof, and wherein, when the recording head stops the recording after the recording operation is started, the exhaust unit operates and the hot air generating unit changes the wind direction so as to form the first air stream.

3. The recording apparatus according to claim 2, wherein the holding member is configured with a carriage which reciprocates the recording head in a direction perpendicular to the transport direction, wherein the hot air generating unit is moved by the carriage, and comes into contact with a hitting member which is provided on one end side of the carriage in a reciprocal direction, so that a wind direction is automatically changed when the first air stream is formed.

4. The recording apparatus according to claim 3, wherein the hot air generating unit is configured to switch a wind direction via a wind direction switching mechanism, wherein the wind direction switching mechanism includes a hot air box which is provided with a bearing unit which is pivotally rotated in a range of a predetermined angle around a pivotal shaft, the hitting member which comes into contact with a part of the hot air box so as to rotate pivotally the hot air box in a range of a predetermined angle around the pivotal shaft, an urging member which urges the hot air box to be rotated in a direction opposite to the pivotal direction, and a posture setting stopper which sets a normal posture in which the hot air box does not come into contact with the hitting member.

5. The recording apparatus according to claim 3, wherein a capping device for the recording head is provided on the other end side which is opposite to the hitting member in the reciprocal direction of the carriage, wherein the hot air generating unit is provided on a side of the recording head facing the hitting member, and wherein the exhaust unit is provided on a side of the recording head facing the capping device.

* * * * *